United States Patent [19]

Marshall et al.

[11] 3,947,538

[45] Mar. 30, 1976

[54] PROCESS FOR UNIFORMILY DRAWING A TOW OF FILAMENTS

[75] Inventors: Geoffrey Marshall; Eric Ivan Riseley, both of Harrogate, England

[73] Assignee: Imperial Chemical Industries, Ltd., London, England

[22] Filed: Sept. 29, 1971

[21] Appl. No.: 184,842

[30] Foreign Application Priority Data

Oct. 22, 1970 United Kingdom ..... 50260/70
Oct. 22, 1970 United Kingdom ..... 50261/70

[52] U.S. Cl. ..... 264/290 T
[51] Int. Cl.[2] ..... B29C 17/02
[58] Field of Search ..... 264/290 TNR, 210 F, 235, 264/346, DIG. 73

[56] References Cited

UNITED STATES PATENTS

| | | | |
|---|---|---|---|
| 2,918,346 | 12/1959 | Paulsen | 264/210 F X |
| 3,221,088 | 11/1965 | Martin | 264/210 F X |
| 3,259,681 | 7/1966 | Bull et al. | 264/290 T |
| 3,414,645 | 12/1968 | Morgan, Jr. | 264/210 F |
| 3,423,501 | 1/1969 | Dennis et al. | 264/210 F X |
| 3,564,835 | 2/1971 | Keefe, Jr. et al. | 264/290 T |

FOREIGN PATENTS OR APPLICATIONS

| | | | |
|---|---|---|---|
| 758,398 | 10/1956 | United Kingdom | 264/290 T |

*Primary Examiner*—Robert F. White
*Assistant Examiner*—James B. Lowe
*Attorney, Agent, or Firm*—Herbert M. Adrian, Jr.

[57] ABSTRACT

Uniformly drawing tows of synthetic linear thermoplastic polymer filaments between sets of feed rolls and draw rolls by saturating a tow while on the feed rolls with water at a temperature of Tg ± 10°C and ensuring that drawing is substantially complete before the tow leaves the last feed roll.

12 Claims, 1 Drawing Figure

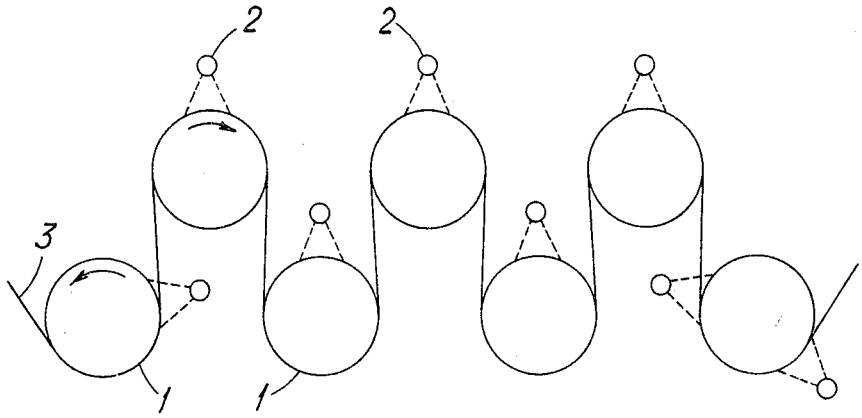
ERIC IVAN RISELEY
GEOFFREY MARSHALL
*Inventors*
By Herbert J. McBrian Jr.
*Attorney*

PROCESS FOR UNIFORMILY DRAWING A TOW OF FILAMENTS

This invention relates to the drawing of synthetic thermoplastic filaments and in particular to a process for drawing tows of synthetic filaments.

In the manufacture of staple fibres from synthetic thermoplastic polymers in order that reasonably high productivity may be achieved large numbers, usually some hundreds, of filaments are produced by melt extrusion of the molten polymer through a multiorifice spinneret and the groups of filaments from a plurality of spinnerets are combined into a tow which is then subjected to a drawing operation to impart the desired physical properties to the filaments comprising the tow. Because of the combination of many thousands of filaments which have been produced under conditions which may vary somewhat it has hitherto been impossible to produce drawn tows of very high uniformity and accordingly some compromise has had to be accepted either in terms of the uniformity of the physical properties of the drawn filaments, or of the freedom to apply different processing conditions, as for example different draw ratios.

We now provide a drawing process by means of which very much more uniform drawing of tows and other benefits may be achieved.

Thus according to the present invention we provide a process for uniformly drawing a tow of filaments of a synthetic linear thermoplastic polymer having a second order transition temperature (Tg) as hereinafter defined of at least 35°C comprising passing a tow at least partly around the peripheries of a plurality of feed rolls in series and a plurality of draw rolls in series the latter rotating at a higher peripheral speed, characterised in that the tow in contact with at least some of the feed rolls is treated with water at a temperature in the range Tg ± 10°C drawing being substantially completed at this temperature before the tow leaves the last feed roll.

Second order transition temperature, Tg, is the temperature below the melting point at which a transition from glass-like to rubberlike or vice versa properties of a polymer substance occurs. The transition appears as a discontinuity in various thermal and mechanical properties of polymers. As defined in this specification Tg is measured at a frequency of 0.002 cycles per second by the dynamic mechanical loss method described by Thompson and Woods in the Transactions of the Faraday Society 1956, 52 1383 using a polymer in the amorphous undrawn condition. As shown by Thompson and Woods Tg for polyethylene terephthalate is 70°C. Alternative methods of measurement of Tg which may be more convenient to apply and which give closely similar values are differential scanning calorimetry (DSC) and differential thermal analysis. In these methods the position of a thermal discontinuity, related to Tg, in the heating up of a specimen of the polymer is observed. Methods for measuring second order transitions by these differential thermal methods are described in "Thermoanalytical methods of Investigation" by P. D. Garn published in 1965 by Academic Press Inc. New York.

A process according to this invention surprisingly operates best within a narrow temperature range as stated above and for polyesters, such as poly(ethylene terephthalate) and copolyesters comprising a major proportion of ethylene terephthalate groups with a minor proportion other diacid or glycol groupings or very small proportions of cross-linking or branching groups, as for example those derived from pentaerythritol having a Tg near that of poly(ethylene terephthalate), it is preferred to use a water temperature of 60°–80°C for application to a tow.

Water at an elevated temperature may be applied in a process according to this invention to all or only some of the feed rolls but if applied only to some of the rolls those to which it is applied should be successive rolls and preferably should include the last roll. In any case water should be applied to a sufficient number of rolls to ensure that drawing is substantially complete before a tow leaves the support of the feed rolls. If the heated water is applied to an undrawn or partially drawn tow without support such as that supplied by feed rolls very uneven drawing results and only a lower speed of drawing is possible. Likewise unless drawing is substantially completed at a uniform temperature uneven drawing will result. Water is preferably applied by means of sprays since by this means the necessary complete wetting and saturation of a tow and all the filaments comprising it may be more easily obtained. Baths into which the surface of a roll carrying a tow dips may also be used but these are less effective in providing complete wetting and saturation of a tow. A preferred alternative to water is a dilute solution or dispersion of a surface active, lubricating or other treating material which on subsequent drying of the tow will leave a residue of the material on the filaments comprising the tow to facilitate subsequent processing of the tow or the staple fibres cut therefrom.

A series of feed or draw rolls may be arranged in line or preferably and to economise on the space required they may be arranged in staggered relationship with the tow passing in sinous fashion over then under successive rolls. In the latter case it may be advantageous to apply the heated water or the treating solution to a tow in contact with the feed rolls by a combination of bath and spray. Needless to say it is beneficial to recirculate the treatment water or solution to save waste of heat or treating material.

In the accompanying drawing a set of seven feed rolls is illustrated together with one suitable placing of heated water jets. In this drawing feed rolls 1 are mounted in a staggered arrangement and eight spray jets 2 are mounted close to the rolls to provide a spray of water or aqueous treatment liquid over a portion of each roll surface and to thoroughly saturate the tow 3 passing thereover. The rolls are driven from a common means (not shown) and rotate in the direction indicated.

In carrying out a process according to this invention it is preferred to control the drawing of the tow so as to be substantially completed on the last feed roll. If this is done the maximum possible draw ratio and hence the highest tenacity products may be achieved. It is believed that this is due to minimising the path length in the feed roll system of the drawn material. Control of the drawing to produce this effect may be achieved in several ways all of which have in common minimising the feed tension of tow supplied to the feed rolls. Thus if a resilient surfaced nip roll is pressed against the tow at the point where it contacts the first feed roll supply tension variations are prevented from passing through into the feed roll system and the desired drawing control is effected. Similarly if the first one or two feed rolls are arranged to operate at a slightly higher peripheral speed than the succeeding feed rolls a low tension in the feed roll system is achieved together with the desired control of drawing. Such alteration of peripheral speed of a feed roll is easily obtained by for example fitting a sleeve to slightly increase the diameter while maintaining the speed of rotation constant.

If the temperature of the water or solution applied to the tow departs from the above specified values undrawn segments will occur at temperatures below the minimum specified, as for example 60°C for polyethylene terephthalate and at temperatures above the upper value undesirable coalescence of filaments at drawing or other undesirable effects occur.

In a process according to this invention it is preferred to provide after the feed rolls means to heat treat the drawn tow at a temperature at least equal to the drawing temperature while the tow is held at substantially constant length since by this means the shrinkage of staple fibres cut from a drawn tow may be reduced to a level desired in subsequent textile processing and in the use of articles made from the fibres. For heating the drawn tow various methods may be used, as for example water baths, steam chambers or microwave heaters but all methods should preferably be capable of heating all the filaments rapidly and for this reason hot air chambers heated by static radiant heaters are not a preferred heating means. Heating of the drawn tow is carried out under tension while the tow is held at substantially constant length and is most easily effected by inserting the heating means between the sets of feed and draw rolls. As the tow is subject to the drawing tension when passing through the heating means a small amount of extra drawing may occur at this stage in the process but the amount of such drawing is only minor and is usually less than 10% of the total drawing. Alternative to inserting heating means between the feed and draw rolls the latter may be heated to provide the heat treatment.

Optionally heating of the drawn tow may be effected by two successive means instead of a single heating means. Thus for example a stream of low pressure steam may be applied to the drawn tow just after it leaves the last feed roll and before it enters a heating means such as a steam chest.

A process according to this invention produces tows which are very significntly more uniformly drawn than was hitherto possible as measured by the substantial absence of undrawn or incompletely drawn segments in the filaments and this is so even when the individual filaments in the undrawn tow vary significantly the birefringence. This capacity to produce uniformly drawn tows from a variable starting material leads to a number of benefits in using the present invention, as for example the possibility of applying a higher draw ratio with consequent improvement in physical properties without incurring broken filaments and an improvement in the range of draw ratios which may be applied without the occurrence of undrawn segments or broken filaments. These improvements in turn lead to higher productivity with its concomitant economic benefits. Productivity is also markedly increased in the present process since very much higher drawing speeds of the order of 200 metres per minute or more, may be employed without incurring any difficulties at drawing or any loss of the desired uniformity of drawing or drawn tow properties.

By the present process tows comprising conjugate filaments may be drawn uniformly and efficiently. Even mixed tows comprising undrawn filaments of widely different birefringence, intrinsic viscosity of filament decitex, which hitherto required separate drawing of the component tows, may be drawn by the present process uniformly and without the occurrence of broken filaments.

Some additional improvement in physical properties, in particular the stability of the initial modulus of the filaments to subsequent heating, may be obtained in a process according to this invention by subjecting the drawn, heat treated tow to a further heat treatment at an elevated temperature, preferably a higher temperature than is used in the preceding heat treatment such a further heat treatment may be applied simply by heating one or more of the draw rolls or by using a third set of rolls with a heating means between these rolls and the draw rolls. In the latter case a small additional stretch may be applied to the drawn, heat treated tow by having a speed differential between the draw rolls and the succeeding rolls.

The following Examples illustrate the invention and the manner in which it may be performed. In these Examples the presence or absence of undrawn segments in the filaments comprising a drawn tow is measured in the following way. A 30 cm. specimen of tow is prepared by folding on itself or by sub-division to produce a thickness of $10^5$ filaments from which a cross section of fibres 3 mm. long is cut from the middle of the folded tow. The short fibres are then dyed with a suitable dye such as Dispersol fast scarlet B (Colour Index No. 11110) and the dye fibres are distributed over a filter paper surface by suction. Undrawn segments appearing as darker specks are counted and expressed as the number per $10^5$ filaments in the 3 mm. cross-section. By this means very small amounts of undrawn fibre segments may be detected. In all these Examples a set of seven feed rolls and seven draw rolls is used to carry out the process with heated water jets positioned as in the drawing and a resilient nip roll applied to the tow on the first feed roll.

EXAMPLES 1 – 4

Sub-tows comprising 1000 polyethylene terephthalate filaments having a total d. tex of 3825 and a mean birefringence of $7 \times 10^{-3}$ are prepared by melt extrusion of a polymer having an intrinsic viscosity (measured at 20°C in solution in o-chlorophenol) of 0.675. A tow comprising 65 sub-tows is passed in a sinous path around part of the periphery of each of seven feed rolls in staggered arrangement. The portions of the tow in contact with each roll are thoroughly saturated by continuous sprays of heated water containing 0.1% by weight of a lubricant dispersed therein and maintained by recirculation through heating means at a constant temperature of 65°C. The quantity of water applied is such as to effectively saturate the whole length of tow passing over and between the feed rolls. On leaving the last feed roll the drawn tow passes through a steam chest 1.5 m. long supplied with low pressure steam at 100°C to a series of seven unheated draw rolls arranged also in staggered fashion. Application of heat to the tow on the feed rolls in this way enables a wide range of drawn ratios to be applied with the results tabulated below:

| Example | Draw Ratio | Tenacity (g/d.tex) | Extension at break (%) |
|---|---|---|---|
| 1 | 3.85:1 | 6.3 | 20 |
| 2 | 3.65:1 | 5.0 | 27 |
| 3 | 3.3 :1 | 4.3 | 41 |
| 4 | 2.9 :1 | 4.1 | 54 |

In all cases the same draw speed (i.e. peripheral speed of the draw rolls) of 90 m. per minute is used and drawing of the filaments in the tow was shown to be complete before the tow leaves the last feed roll by briefly stopping the drawing process and instantaneously cutting out the section of the tow in contact with the feed rolls for close examination.

No undrawn filaments segments could be detected in any of the tows produced in Examples 1 – 4 when examined carefully by the method hereinbefore described.

COMPARATIVE EXAMPLE A

An undrawn tow as used in Examples 1 – 4 is drawn at a draw speed of 90 m. per minute between feed and drawn roll septets not having means to apply heated water to the feed rolls but using instead to control drawing a narrow jet of steam impinged upon the tow spread out in a band the steam penetrating through the band and between the filaments and the tow then passing into a steam chest as used in Examples 1 – 4.

Comparatively poor drawing results and only a narrow range of draw ratios may be applied without the occurence of broken filaments or excessively large amounts of undrawn fibre segments. Even over the just workable range of draw ratios, 3.5:1 to 3.75:1, 5 – 20 undrawn segments per $10^5$ filaments occured. These amounts of undrawn segments are unacceptably high for many textile purposes.

EXAMPLES 5 – 6

A tow as used in Examples 1 – 4 is drawn as in those Examples but using heated water temperatures of 70°C and 80°C. In these cases the maximum operable draw ratio (i.e. no broken filaments) is increased compared with water at 65°C. In both cases the draw speed is 90 m. per minute.

| Example | Maximum Draw Ratio | Tenacity (g/d.tex) | Extension at break |
|---|---|---|---|
| 5(80°C) | 4.01 | 6.8 | 16 |
| 6(70°C) | 3.95 | 6.7 | 20 |

using a bath of the lubricant dispersion as sprayed onto the feed rolls in place of the steam chest, the temperature of this bath being 70°C. No undrawn segments could be detected in the drawn materials.

EXAMPLE 8

Tows comprising 28000 filaments of (a) an ethylene terephthalate/isophthalate co-polymer containing 20 moles % ethylene isophthalate (Tg 72°C by DSC) and (b) an ethylene terephthalate/adipate copolymer containing 20 moles % of ethylene adipate (Tg 36°C by DSC) are drawn as in Examples 1 – 4 using various water spray temperatures to determine the temperature ranges of effective drawing i.e. no undrawn segments, coalescence, broken filaments or other undesirable effects, for each copolymer tow. It is found that the effective water temperature ranges are;

a. terephthalate/isophthalate 60°–80°C b. terephthalate/adipate 30°–50°C

Draw ratios of 3.3:1 to 4.2:1 could be used in these temperature ranges with equal effectiveness.

By comparison drawing of the terephthalate/isophthalate tow using a steam jet and steam bath to effect the drawing could only be carried out at a maximum draw ratio of 3.6:1 and drawing of the terephthalate/adipate tow in a heated water bath at draw ratios up to 3.4:1 even when the bath temperature is raised to 60°C. without incurring the presence of undrawn segments in the tows.

COMPARATIVE EXAMPLE B

A poly(ethylene terephthalate) tow as used in Examples 1–4 is drawn between feed and draw roll septets by passage through a series of water sprays supplied with water at 65°C situated between the feed and draw rolls. Even at a draw ratio of 3.1:1 undrawn segments occurred in the drawn tow at the unacceptable level of 5 per $10^5$ filaments. As the draw ratio is increased the amount of undrawn segments in the drawn tow rapidly increased even at the draw speed used of 90 meters per minute.

EXAMPLES 9 – 11

These Examples illustrate the benefit of applying a heat treatment to drawn tow while it is maintained under tension.

A poly(ethylene terephthalate) tow as used in Exampled 1 – 4 is drawn using feed roll sprays supplying a 0.1% aqueous lubricant dispersion at 65°C and then is subjected to heat treatment either in water or a steam bath before passing over the draw rolls. The following table shows the results of the heat treatments;

| Example | Heat treatment | Draw ratio | Undrawn segments per $10^5$ filaments | Free shrinkage in boiling water % |
|---|---|---|---|---|
| 9 | Water bath at 65°C | 3.8:1 | 0 | 14 |
| 10 | Water bath at 80°C | 3.8:1 | 1 | 12 |
| 11 | Steam bath (100°C) | 3.8:1 | 0 | 8 |

EXAMPLE 7

A tow of the same size as used in the foregoing Examples but comprising filaments of an ethylene terephthalate polymer containing 0.3% by weight of pentaerythritol which acts as a cross-linking agent, is drawn at a draw ratio of 3.0:1 to 3.2:1 as in Example 6 but

EXAMPLES 12 – 13

These Examples illustrate the beneficial effect of a second post drawing heat treatment particularly in stabilising the initial modulus of the drawn tow. Initial modulus is conveniently expressed as the load required to extend a tow or a specimen of filaments therefrom by 10% of their initial length.

A poly(ethylene terephthalate) tow as used in Examples 9 – 11 is drawn and heat treated as in Example 11 the draw ratio being 3.75:1, and is then further heat treated by passage over draw rolls heated to a surface temperature of 195°C. The effect of this further heat treatment is shown in the following table wherein the properties of a tow drawn and heat treated in the same way but without the further heat treatment on the draw rolls are given;

| Example | Post drawing Treatment | Undrawn segments per $10^5$ filaments | Tenacity* g/d.tex | Load at 10% extension* g/d tex |
|---|---|---|---|---|
| 12 | Steam bath/ hot draw rolls | 0 | 6.6 | 5.5 |
| 13 | Steam bath/ ambient draw rolls | 0 | 5.7 | 2.2 |

*after relaxed heat treatment at 115°C.

COMPARATIVE EXAMPLE C

A tow as used in Examples 9 – 13 is drawn by the conventional steam jet and steam chest means and is thereafter further heat treated by passage over draw rolls heated to 195°C. A draw ratio of only 3.5:1 could be applied and the drawn and heat treated tow has the following properties;

| Example | Treatment | Tenacity g/d.tex | Load at 10% extension g/d.tex | Undrawn segments per $10^5$ filaments |
|---|---|---|---|---|
| C | Drawn and heat treated | 5.2 | 4.5 | 20 |

EXAMPLE 14

A tow consisting of 24500 conjugate filaments each comprising a core of poly(ethylene terephthalate) of intrinsic viscosity 0.40 and a sheath of poly(ethylene terephthalate) of intrinsic viscosity 0.485 is drawn with feed roll sprays at 65°C. The proportion of core to sheath is 80:20 and the intrinsic viscosity of the polymers used is measured at 25°C in solution in o-chlorophenol. Draw ratios from 3.5:1 to 4.4:1 could be applied without incurring any undrawn segments or broken filaments.

By comparison when drawing was attempted in the absence of feed roll sprays using instead a water bath at 75°C between the feed and draw rolls a maximum draw ratio of only 3.6:1 could be applied.

EXAMPLE 15

In this Example a 50:50 mixed tow is used comprising (a) poly(ethylene terephthalate) filaments of 0.65 intrinsic viscosity, $7.2 \times 10^{-3}$ birefringence and 4.7 d.tex per filaments and (b) poly (ethylene terephthalate) filaments of 0.47 intrinsic viscosity, $4.0 \times 10^{-3}$ birefringence and 12.5 d.tex per filament the total tow being 3.47 Kilotex. The mixed tow draws easily and without the occurence of undrawn segments or broken filaments at a draw ratio of 3.56:1 when all the feed rolls are sprayed with lubricant dispersion, as used in the preceding Examples, at 65°C. Filaments of each kind of drawn tow have the following properties, the filaments being identified by using different levels of delustrant in the starting tows;

| Tow | Filament d.tex | Tenacity g/d.tex | Extension at Break % |
|---|---|---|---|
| (a) | 1.37 | 5.5 | 25 |
| (b) | 3.78 | 3.3 | 44 |

By any conventional means such as hot water or steam baths between the feed rolls and draw rolls it was impossible to draw the foregoing mixed tow due to continuous breakage of filaments.

EXAMPLE 15

A tow of 65000 poly(ethylene terephthalate) filaments containing 0.02% of titanium dioxide delustrant and having a birefringence of $7.2 \times 10^{-3}$ is drawn using a spray temperature of 65°C at several draw speeds and at a draw ratio of 3.83:1 which is very close to the maximum for effective drawing. Drawing could be carried out easily and without the occurence of undrawn segments or broken filaments at speeds up to at least 170 m. per minute, the drawn tows having the following properties (after relaxed heat treatment at 115°C)

| Draw speed m/min. | Tenacity g/d.tex | Extension at Break % | Load at 10% extension g/d.tex |
|---|---|---|---|
| 35 | 5.9 | 19.8 | 5.2 |
| 115 | 6.0 | 18.3 | 4.1 |
| 170 | 5.9 | 17.9 | 3.9 |

By comparison when the same tow is drawn in the conventional manner by means of a steam jet and steam chest situated between the feed and draw rolls the process could only be operated at a draw speed up to 90 m. per minute and a maximum draw ratio of 3.75:1 giving a drawn product having 26 undrawn segments per $10^{-5}$ filaments, a tenacity of 5.4 g. per d.tex and an extension at break of 26.1%.

EXAMPLE 16

This Example illustrates the control of drawing with the feed roll system which is effected by means of a resilient nip roll applied to the tow on the first feed roll.

A poly(ethylene terephthalate) tow as used Examples 1 – 4 is drawn at a draw ratio of 3.52:1 with sprays on the feed rolls at a temperature of 65°C and the places at which drawing begins and ends is determined by briefly stopping the drawing process and instantaneously cutting out the section of tow in contact with the feed rolls for close examination. The results of operating the drawing process with and without the nip roll applied are as follows;

| Nip roll | Tow tension, g/undrawn d.tex | | Position of draw | |
|---|---|---|---|---|
| | Immediately before 1st feed roll | Immediately after 1st feed roll | Beginning | Ending |
| On | 0.052 | 0.022 | Between 5th and 6th rolls | On 7th roll |
| Off | 0.052 | 0.041 | Between 4th and 5th rolls | On 6th roll |

EXAMPLE 17

A tow of 65000 poly(ethylene terephthalate) filaments as used in Example 15 is drawn as in that Example but over a wide range of draw ratios with the following results.

| Draw ratio | Tenacity g/d.tex | Extension at break % | Undrawn segments per $10^5$ filaments |
|---|---|---|---|
| 3.85:1 | 6.3 | 20 | 0 |
| 3.65:1 | 5.5 | 27 | 0 |
| 3.3 :1 | 4.2 | 41 | 0 |
| 2.7 :1 | 3.9 | 54 | 2 |

COMPARATIVE EXAMPLE D

A tow as used in Example 17 is drawn by the conventional means of a steam jet and steam chest placed between the feed and draw rolls. A maximum draw ratio of 3.75:1 only could be applied due to the high incidence of broken filaments and even at lower draw ratios drawing was not entirely satisfactory particularly in respect of the high incidence of undrawn segments as the following results show;

| Draw ratio | Tenacity g/d.tex | Extension at break % | Undrawn segments per $10^5$ filaments |
|---|---|---|---|
| 3.75:1 | 5.4 | 26 | 16 |
| 3.3 :1 | 4.2 | 37 | 100 |
| 2.7 :1 | 3.6 | 70 | 1000 |

EXAMPLE 18

In a larger scale drawing according to this invention 7000 lb. of drawn poly(ethylene terephthalate) tow are produced by drawing a 50 Kilotex tow at a draw ratio of 4.16:1 over a septet of feed rolls and a septet of draw rolls the former being drenched with sprays of an aqueous lubricant at 67°C. Completely effective drawing is obtained the drawn product having a mean undrawn segments per $10^5$ filaments (mean of 23 specimens) of 1.3 and means tenacity and extension at break of 7.0 g. per d.tex and 26.5%.

We claim:

1. A process for uniformly drawing a tow of filaments of a synthetic linear thermoplastic polymer having a second order transition temperature (Tg) as hereinafter defined of at least 35°C comprising passing a tow at least partly around the peripheries of a plurality of feed rolls in series and subsequently around a plurality of draw rolls in series the latter rotating at a higher peripheral speed, characterized in that substantially undrawn tow is initially passed to said feed rolls, spraying said tow while in contact with more than one of said feed rolls with a saturating amount of heated water at a temperature in the range Tg ± 10°C and drawing said tow to substantially the desired extent at said temperature before the tow leaves the last feed roll.

2. A process according to claim 1 wherein the tow comprises polyester filaments which are sprayed with water at a temmperature of 60°–80°C.

3. A process according to claim 2 wherein the filaments comprise polyethylene terephthalate.

4. A process according to claim 1 wherein heated water is applied to all the feed rolls.

5. A process according to claim 1 wherein the water is applied to less than all the feed rolls by means of sprays directed at the tow on a succession of feed rolls including the last feed roll.

6. A process according to claim 1 wherein the tow tension within the feed roll system is controlled by a resilient surfaced nip roll applied to the tow on at least the first feed roll.

7. A process according to claim 1 wherein the drawn tow is heat treated at a temperature at least equal to the drawing temperature while it is held at substantially constant length.

8. A process according to claim 7 wherein the heat treatment is applied by heating means placed between the feed and draw rolls.

9. A process according to claim 8 wherein the heating means is a steam chest.

10. A process according to claim 9 wherein a steam jet which impinges on the tow is placed immediately before the steam chest.

11. A process according to claim 8 wherein the heat treatment is provided by heating at least some of the draw rolls.

12. A process according to claim 7 wherein the heat treated tow is further heat treated at a temperature higher than that of the first heat treatment.

* * * * *